US010837186B2

(12) United States Patent
Pellerin, II

(10) Patent No.: US 10,837,186 B2
(45) Date of Patent: Nov. 17, 2020

(54) PATCHING COMPOUND DISPENSER-APPLICATOR

(71) Applicant: William Pellerin, II, Ocala, FL (US)

(72) Inventor: William Pellerin, II, Ocala, FL (US)

( * ) Notice: Subject to any disclaimer, the term of this patent is extended or adjusted under 35 U.S.C. 154(b) by 0 days.

(21) Appl. No.: 16/186,565

(22) Filed: Nov. 11, 2018

(65) Prior Publication Data

US 2020/0165830 A1 May 28, 2020

(51) Int. Cl.

| | |
|---|---|
| ***B27G 1/00*** | (2006.01) |
| ***E04G 23/02*** | (2006.01) |
| ***B05C 11/04*** | (2006.01) |
| ***B05C 1/06*** | (2006.01) |
| ***B05C 17/00*** | (2006.01) |
| ***B65D 35/02*** | (2006.01) |

(52) U.S. Cl.
CPC ..... *E04G 23/0203* (2013.01); *B05C 1/06* (2013.01); *B05C 11/04* (2013.01); *B05C 11/044* (2013.01); *B05C 17/002* (2013.01); *B27G 1/00* (2013.01); *B65D 35/02* (2013.01)

(58) Field of Classification Search
CPC . B05C 17/00583; B05C 17/005; B05C 17/00; B05C 11/04; B05C 11/044; B05C 11/0048; B05C 1/025; B05C 1/06; B05C 17/002; B05C 17/003; E04G 23/0203; E04G 23/02; E04G 23/0207; B27G 1/00; B27G 11/00; A46B 11/0041; B65D 35/00; B65D 35/02; B65D 35/08; B65D 35/26
See application file for complete search history.

(56) References Cited

U.S. PATENT DOCUMENTS

| | | | | |
|---|---|---|---|---|
| 2,820,234 A * | 1/1958 | Rigney | A47L 17/00 | 401/186 |
| 4,008,968 A * | 2/1977 | Hobbs | A47L 17/00 | 401/207 |
| 4,451,164 A * | 5/1984 | Roberts, Jr. | A47L 13/17 | 400/274 |
| 5,248,211 A * | 9/1993 | Hoist | A47L 1/15 | 15/227 |

* cited by examiner

*Primary Examiner* — David J Walczak
(74) *Attorney, Agent, or Firm* — Massinger Law Offices

(57) ABSTRACT

A refillable combination patching compound dispenser and applicator has a generally cone-shaped container having a normally open end through which patching compound is introduced, a closed end terminating in a tip, a dispensing aperture disposed through the side-wall of container, proximate the tip, and a disc-shaped applicator having a center opening in communication with the dispensing aperture through which patching compound is dispensed. The apparatus is ergonomically shaped to fit easily in the palm of the user's hand and includes a fingertip rest opposite the dispensing aperture to facilitate application of patching compound in any direction over the substrate surface.

20 Claims, 7 Drawing Sheets

PATCHING COMPOUND DISPENSER-APPLICATOR

FIELD OF THE INVENTION

The present invention is directed to a dispenser-applicator adapted for applying spreadable substances to solid surfaces. More particularly, the present invention is directed to a dispenser-applicator for applying patching compounds to surfaces of wood, plaster, drywall and the like.

BACKGROUND OF THE INVENTION

Modern patching compounds are typically pre-mixed ready to use spreadable paste or putty-like products sold in plastic tubs, jars and tubes, and which are designed to repair small imperfections in the surfaces of wood, plaster, drywall and the like. The term "spackle" was originally a trademark for a specific product but has come to be used as a generic term for patching compounds. Patching compounds typically dry quickly and remain workable for only a few minutes. Accordingly, because it is not possible to leave the lid off of the patching compound container for any appreciable period of time without drying out and ruining the compound, the user must repeatedly remove and remount the lid each time more compound is obtained, typically by extracting a portion on the blade of a putty knife or other similar applicator. In order to save time associated with this repetitious task, it is a common practice of tradesmen facing larger repair jobs to transfer a larger amount of compound from the container to a damp rag and roll it up inside in the form of a ball. This technique is especially useful when patching a myriad of smaller holes and cracks because the user can transfer a small amount of material from the rag onto a fingertip for application onto the surface to be patched. The use of fingertips rather than a tool for patching small holes and cracks is also a very common technique with some advantages not the least of which is that there is no tool to handle, drop or misplace. Moreover, the user has a certain degree of control over the material based on tactile sensation or "feel" which can speed application. Unfortunately, these techniques are not without their shortcomings. First, the user is constantly required to wipe dried material from the fingertips onto the damp rag so that the dried material does not interfere with application of fresh material generally, and with leaving a smooth uniform appearance in particular. The dried material on the rag usually ends up dropping all over the floor and tracked around with the shoes leaving the jobsite unsightly and requiring more cleanup time. Additionally, because fingertips are somewhat pliable, the skin can be forced into the holes or cracks to be repaired when too much pressure is applied leaving divots that must later be filled in with more material. It can be challenging, therefore, to fill the imperfection with a flat smooth finish which cuts down on sanding time.

Based on the above, there is a need in the art for a patching compound dispenser and applicator capable of holding ample amounts of compound, dispensing the compound onto the work surface in a controlled manner and for simultaneously spreading the compound in a smooth even manner.

SUMMARY OF THE INVENTION

The subject invention meets the above-described need in the art by providing a combination patching compound dispenser and applicator. More specifically, embodiments of the dispenser-applicator of the subject invention are comprised of a generally cone-shaped bag typically constructed of a non-water permeable sheet good material, the bag having a charging aperture defined by the perimeter of the open "base" of the cone for introducing patching compound into the bag, and a dispensing aperture through the cone wall, proximate the tip or apex of the cone, through which the patching compound is dispensed onto the substrate surface to be repaired or prepped, as applicable. Embodiments of the invention include a disc-shaped applicator preferably but not essentially made of plastic or rubber polymer having an outer diameter, an inner diameter defining an opening, and top and bottom co-planar surfaces therebetween. The opening of the applicator is in communication with the dispensing aperture such that patching compound may be dispensed first through the dispensing aperture and then through the applicator opening. A novel aspect of the subject apparatus is the shape of the applicator. Unlike typical putty knives or other applicator blades of the prior art having a straight edge which can only be drawn linearly across the substrate surface in the direction of the applicator's handle, the disc shape of the applicator facilitates spreading and smoothing of the patching compound in any radial direction (i.e., in any radius normal to the center axis of the applicator opening). A fingertip rest is disposed on the outer surface of the cone wall, opposite the applicator, to facilitate manipulation of the applicator in any such direction.

Other embodiments of the invention include a mesh applicator, preferably but not essentially polyethylene mesh, adhered to the bottom surface of the applicator which has been found to be useful in repairing imperfections in irregularly shaped surfaces such as door trim, for example, because of its ability to conform to the contours of the irregular surface. In embodiments of the invention, the top surface of the applicator may be adhered to the outer surface of the cone wall. Alternatively, the applicator may be fastened to the cone wall, around the dispensing aperture, using a speed fastener or other fastening component that is generally I-shaped in cross section. The fastener may be adapted to receive peripheral articles such as a closure cap and straight edged spatula.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is, therefore, a primary object of the subject invention to provide a combination patching compound dispenser and applicator comprised of a generally cone-shaped bag having a charging aperture for introducing patching compound into the bag, and a dispensing aperture through the cone wall and proximate the truncated end of the cone.

It is another primary object of the subject invention to provide such a patching compound dispenser and applicator further including a disc-shaped applicator circumscribing the dispensing aperture, the applicator being useful for spreading patching compound in any direction of travel over the planar surface of the substrate being worked.

Another object of the subject invention is to provide a combination patching compound dispenser and applicator that is ergonomic in form and therefore easily controlled over the substrate surface.

Another object of the subject invention is to provide a combination patching compound dispenser and applicator that is refillable and easy to clean, and which mitigates against the patching compound from drying out, forming clumps or otherwise becoming unusable.

Still another object of the subject invention is to provide a combination patching compound dispenser and applicator which is relatively simple in design and therefore capable of rapid construction at relatively low costs.

Yet another object of the subject invention is to provide a combination patching compound dispenser and applicator that can be folded flat for or rolled into a cylinder shape thereby affording numerous packaging and product display options.

These together with other objects of the invention, along with the various features of novelty which characterize the invention, are pointed out with particularity in the claims annexed to and forming a part of this disclosure. For a better understanding of the invention, its advantages and the specific objects attained by its uses, reference should be had to the accompanying drawings and descriptive matter in which there is illustrated a preferred embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENT

Figure 3:
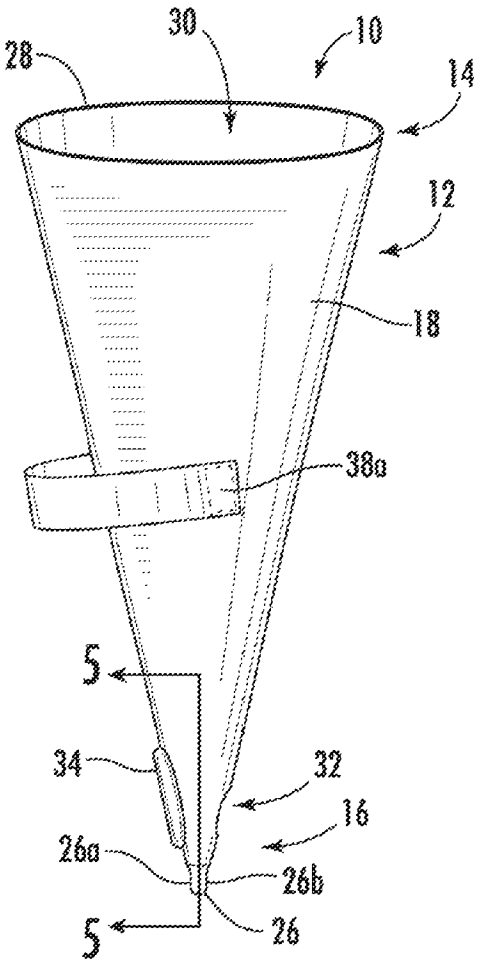
FIG. 3 is a side perspective view of combination patching compound dispenser and applicator of the subject invention.

At the outset, it should be clearly understood that like reference numerals are intended to identify the same structural elements, portions or surfaces consistently throughout the several drawings figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. The figures provided herewith are for explanation purposes to persons ordinarily skilled in the art and that the drawings are not necessarily drawn to scale.

In addition, as used in the following description, any reference to terms of orientation such as "horizontal", "vertical", "front", "rear", "left", "right", "up", "down", "inward" or "outward", "proximate", "distal", as well as adjectival and adverbial derivatives thereof (e.g., "horizontally", "vertically", "forwardly", "rearwardly", "leftward", "rightward", "upward", "downward", "inwardly" or "outwardly"), generally refer to the orientation of a surface or structure relative to its axis of elongation, or axis of rotation, as appropriate. One of ordinary skill in the art will also appreciate that a component may be designed as multiple components or that multiple components may be designed as a single component.

Furthermore, reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples.

Figure 2:
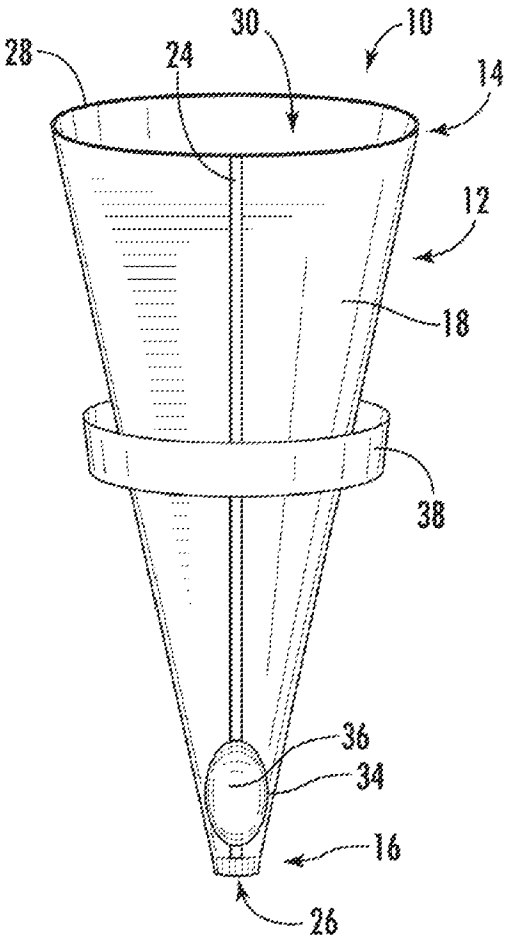
FIG. 2 is a top perspective view of combination patching compound dispenser and applicator of the subject invention.
Figure 1:
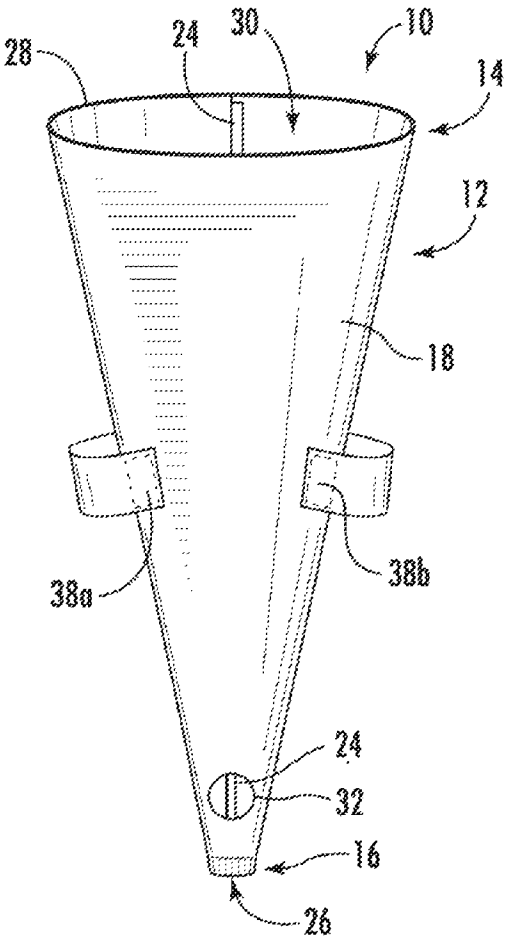
FIG. 1 is a bottom perspective view of combination patching compound dispenser and applicator of the subject invention.
Figure 4:
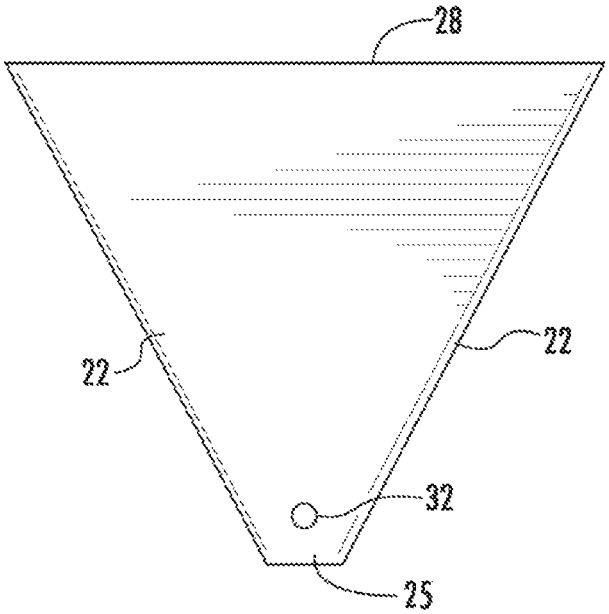
FIG. 4 is a plan view of a precut non-water permeable sheet good material prior to being rolled into a truncated cone shape of the subject invention.
Figure 5:
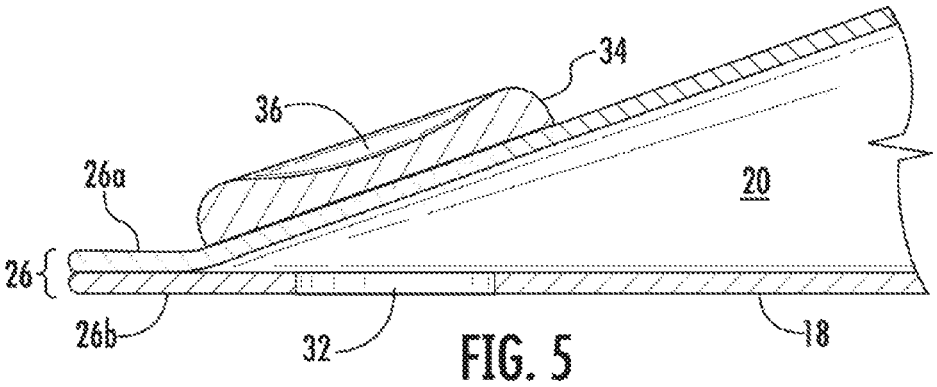
FIG. 5 is an enlarged side sectional view of the dispensing end of a basic embodiment of a combination patching compound dispenser and applicator of the subject invention.

Reference is now made to FIGS. 1-3 in which there is illustrated a combination patching compound dispenser and applicator of the subject invention. Hereinafter, all embodiments of the subject combination patching compound dispenser and applicator shall be referred to more simply as "dispenser/applicator" and are designated generally by reference numeral 10. Dispenser/applicator 10 as shown in FIGS. 1-3 is comprised of a generally cone-shaped non-rigid container or "bag" 12 having a normally open proximal end 14, a closed distal end 16, and a side-wall 18 between the proximal and distal ends 14 and 16, respectively, and forming a chamber 20 for holding patching compound. Bag 12 is fabricated from a non-water permeable sheet good material. In some embodiments, the sheet good material may be a vinyl laminated fabric wherein the vinyl laminated plastic forms the inside surface of the bag, thereby sealing moisture therein when the distal end is closed, and the outer fabric layer provides a non-slip grip for the user. The sheet is cut into substantially the shape of a triangle having one tip of one corner removed as shown in FIG. 4. Thusly cut, the material is rolled into a truncated cone shape in the fashion of a cake decorating bag with the overlapping lateral edges 22 of the sheet being secured together by heat sealing, gluing and/or sewing, as appropriate for the selected material, to form side seam 24. The sheet may be rolled about a cone-shaped mandrel to achieve the desired shape and facilitate fabrication. Unlike a cake decorating bag which leaves the truncated end open for dispensing of the decorating media, distal end 16 is closed. This is accomplished by flattening distal end 16 until the distal edge 24 overlaps itself, and then securing the overlapping ends together using one or more of the above described methods to form tip 26. Tip 26 is relatively narrow in profile as compared to it relatively broad top and bottom surfaces 26*a* and 26*b*, respectively.

The proximal end 14 of bag 12 terminates in proximal edge 28 which defines charging aperture 30. Charging aperture 30 serves as the opening through which patching compound may be introduced into chamber 20 and thus, should have a diameter suitably sized for this purpose. For smaller sized units of the subject apparatus 10, charging aperture 30 has diameters ranging from 2 inches to 4 inches. For larger sized units, charging aperture 30 has diameters ranging from 3 inches to 6 inches, although the maximum diameter is really determined by practicality, namely if it is too large, the apparatus as a whole will become unwieldy. To that end, bags having an overall length of 8 inches to 12 inches are considered optimal. Anything larger would be difficult to manage by one hand.

Figure 9:
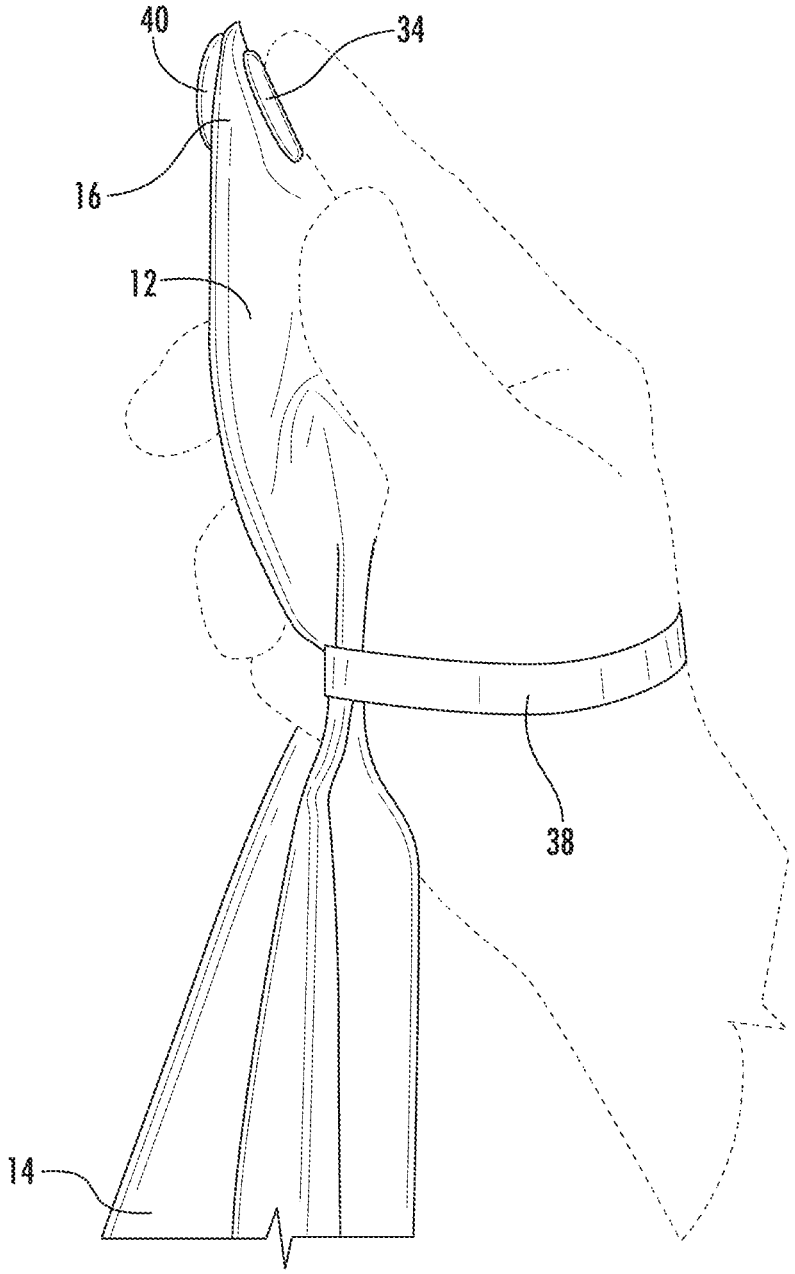
FIG. 9 is a side perspective view a combination patching compound dispenser and FIG. 10 is an enlarged side sectional view of the dispensing end of another embodiment of a combination patching compound dispenser and applicator of the subject invention wherein the applicator disc is further secured in place with a dome-headed fastener.

Distal end 16 includes a dispensing aperture 32 disposed through side-wall 18, proximate the bottom surface 26*b* of tip 26. Dispensing aperture 32 is the orifice through which the patching compound is dispensed onto the substrate surface to be repaired or prepped, as applicable. A fingertip rest 34 is affixed to and projects outwardly from the outer surface of side-wall 18, opposite dispensing aperture 32. As may be readily appreciated by reference to FIG. 9, the bag 12 of the subject invention is shaped to ergonomically conform to the palmar side of a user's hand with the index finger pointing toward distal end 16 and the fingertip resting on fingertip rest 34. The remaining fingers of the user are wrapped about the body of bag 12 and are used to exert pressure against side-wall 18 to move the patching compound distally toward and out of dispensing aperture 32 in a controlled fashion. Fingertip rest 34 conforms to the surface curvature of side-wall 18 and includes a round or oval shaped concave depression 36 for receiving the user's fingertip which may be used for guiding the distal end 16 in any direction across a substrate surface. Fingertip rest 34 may be made of a plastic or rubber polymer such as may be injection molded from thermoplastic or thermosetting polymers. In some embodiments, an elastic band 38 is fixed to side-wall 18 between proximal and distal ends 14,16 by heat sealing, gluing and/or sewing its ends 38*a*,38*b* to the side-wall. As illustrated in FIG. 9, a user's hand may be inserted between bag 12 and band 38 to permit relaxing of the user's fingers and prevent bag 12 from being dropped. An additional use of strap 38 is as a keeper for the open proximal end 16 of bag 12. Once patching compound is introduced into chamber 20, proximal end 16 may be closed by twisting about itself (like a cake bag) and/or folded over upon itself and inserted underneath strap 38. Strap 38 can be cut to a length that would yield a tighter fit about bag 12 than is illustrated in FIGS. 1-3.

The dispenser/applicator 10 described above represents the simplest embodiment of the subject invention. As may be appreciated, location of dispensing aperture 32 through side-wall 18 on one "side" of bag 12 and directly underneath a fingertip rest 34 on the opposite side of the bag enables the user to dispense the patching material directly underneath the fingertip which affords great control over the patching material. The user essentially points to where the material is to be applied and presses the material in place by applying finger pressure to the corresponding fingertip rest 34. The material can be applied in any direction by applying pressure against that portion of the depression 36 that corresponds with the desired direction of application.

Figure 6:
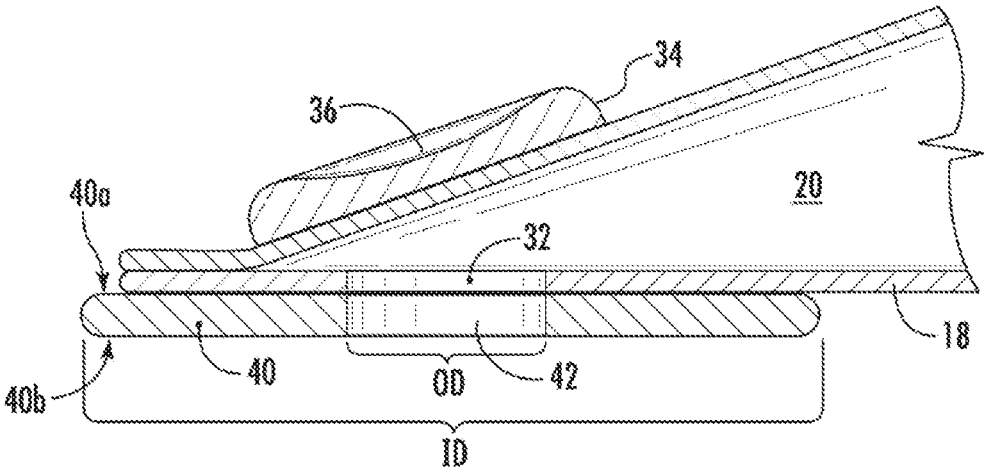
FIG. 6 is an enlarged sectional view of the dispensing end of another embodiment of a combination patching compound dispenser and applicator of the subject invention having a disc-shaped applicator affixed to the cone side wall.
Figure 7:
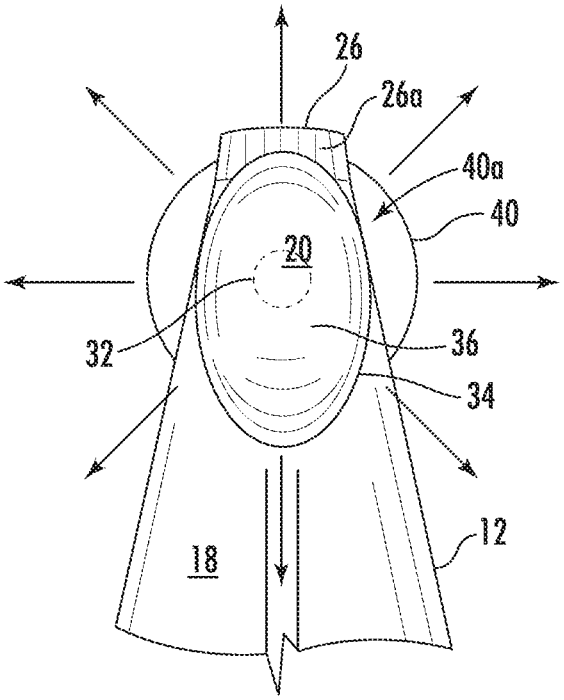
FIG. 7 is plan view of the combination patching compound dispenser and applicator of FIG. 6.
Figure 8:
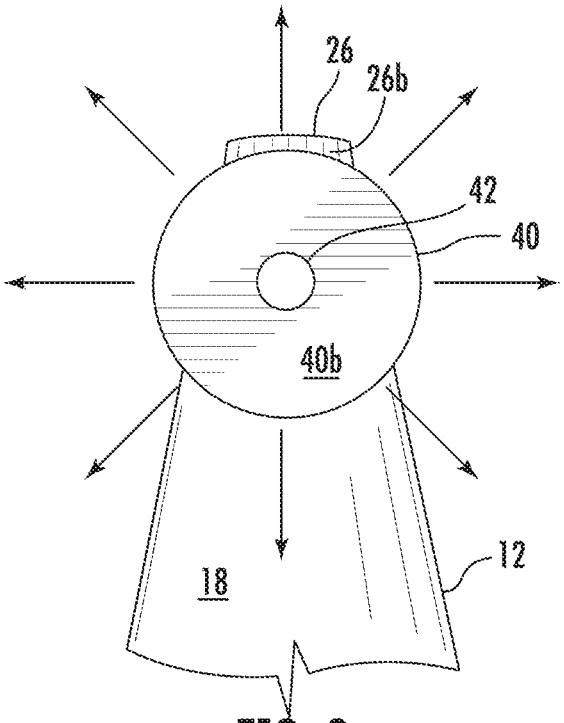
FIG. 8 is a bottom view of the combination patching compound dispenser and applicator of FIG. 6.

Reference now being made to FIGS. 6-8, another embodiment of the subject invention further includes a disc-shaped applicator disc 40 fixed to side-wall 18 of bag 12. Applicator disc 40 may be made of plastic or rubber polymer, nylon, steel, metal, alloy, fibers, ceramics, rubber, felt, leather, wood, mica or any other suitable material. Examples of thermoplastics and thermosetting polymers are polyethylene and PTFE (Teflon). Examples of nylon are Nylon 6, Nylon 66, Nylatron, and Tecamid MDS. Applicator disc 40 is generally a thin plate, flat in profile, having top and bottom surfaces 40*a* and 40*b*, respectively, with a hole 42 in the middle (hole 42 is also referred to as "opening 42" when applicator disc 40 is attached to bag 12). In an embodiment of the subject invention, applicator disc 40 is fixed to bag 12 using an adhesive between at least a portion of top surface 40*a* and side-wall 18. In all embodiments, applicator disc 40 is positioned on bag 12 such that opening 42 is in communication with dispensing aperture 32. Thusly positioned, patching compound may be dispensed first through dispensing aperture 32 and then through opening 42 of applicator disc 40 and onto the substrate surface.

Applicator disc 40 has an outer diameter OD at least twice the size of its inner diameter ID. Depending on the size of imperfections in the substrate to be repaired or patched, applicator disc 40 can have a particularly large OD in proportion to its central hole 42. In some embodiments, the outer circumference of applicator disc 40 is rounded (as shown) or beveled. Applicator disc 40 may be rigid or semi-rigid. The outer diameter of applicator disc 40 may range from 10 mm to 100 mm with a range of 15 mm to 60 mm being ideal for most applications.

Figure 10:
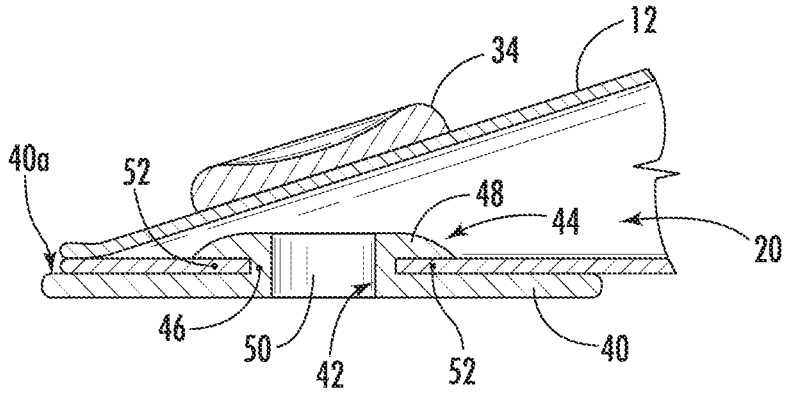

Referring now to FIG. 10, there is illustrated an alternative means for attaching applicator disc 40 to bag 12. Specifically, applicator disc 40 may be removably mounted or permanently affixed to a fastener 44 that circumscribes dispensing aperture 32. In one embodiment, fastener 44 is T-shaped in profile having a ring-shaped fastener base 46 integrally disposed between applicator disc 40 and flanged fastener head 48. When viewed in profile, together applicator 40, fastener base 46 and fastener head 46 form an I-shape with the circumferential edge 52 of dispensing aperture 32 sandwiched in between fastener head 48 and top surface 40*a* of applicator disc 40. Fastener base 46 has an outer diameter substantially equal to the diameter of dispensing aperture 32, and an inner diameter substantially equal to the diameter of opening 42 of applicator disc 40. Fastener head 48 is parallel to top surface 40*a* of applicator disc 40. Fastener base 46 and fastener head 48 share in common a centrally disposed bore 50 having a first end in communication with chamber 20 and a second end in communication with opening 42 of applicator 40. In embodiments of the invention, fastener head 48 is dome-shaped to facilitate movement of patching compound over its tapered edges as opposed to becoming clumped around its edges if they were non-tapered. As may be appreciated, fastener 44 and applicator disc 40 may be of unibody construction or may be separate components in mating engagement with one another. In embodiments of the invention, fastener 44 may be of a type having the ability to apply a clamping force around circumferential edge 52 of dispensing aperture 32, such as a speed fastener, for instance.

Figure 11:
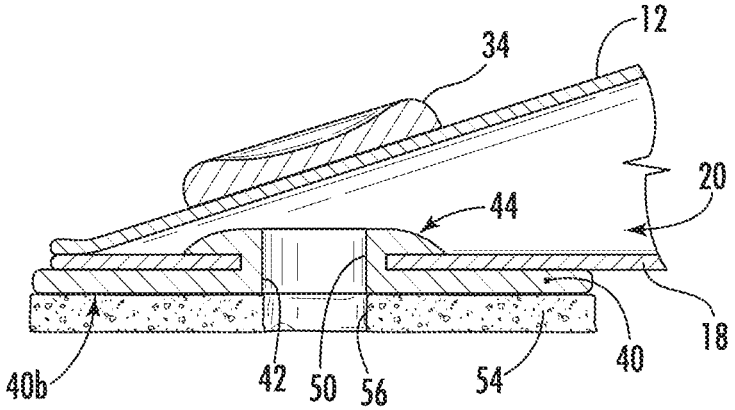
FIG. 11 is an enlarged side sectional view of the dispensing end of the combination patching compound dispenser and applicator of FIG. 10 further including a mesh applicator disc fixed to the bottom surface of the applicator.

Referring to FIG. 11, embodiments of the invention further include a mesh applicator disc 54, preferably but not essentially polyethylene mesh, fixed to the bottom surface 40*b* of applicator disc 40 using an adhesive. Mesh applicator disc 54 is sized and shaped to be substantially the same as applicator disc 40. In some embodiments, mesh applicator disc 54 is sufficiently porous to allow patching compound to be extruded through it when dispensed through opening 42 of applicator disc 40. In other embodiments, mesh applicator disc 54 includes a hole 56 in communication with opening 42 to allow passage of patching compound. Mesh applicator disc 54 has been found to be useful in repairing imperfections in irregularly shaped surfaces such as door trim, for example, because of its ability to conform to the contours of the irregular surface. As should be appreciated, mesh applicator disc 54 may also be fixed to the bottom surface of the applicator disc 40 as shown in FIG. 6 (which does not include a fastener 44).

Figure 12:
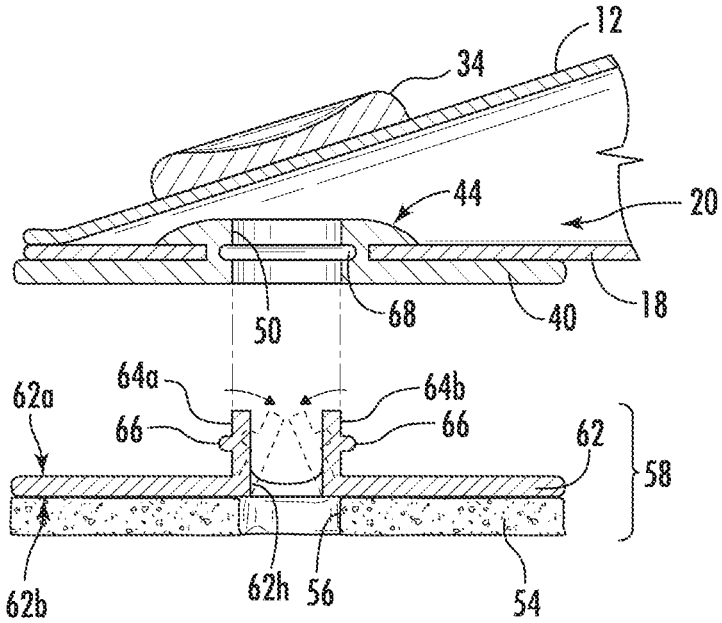
FIG. 12 is an enlarged side sectional view of the dispensing end of the combination patching compound dispenser and applicator of FIG. 10 wherein the fastener is modified to receive a variety of peripheral attachments including the mesh applicator attachment as shown.
Figure 13:
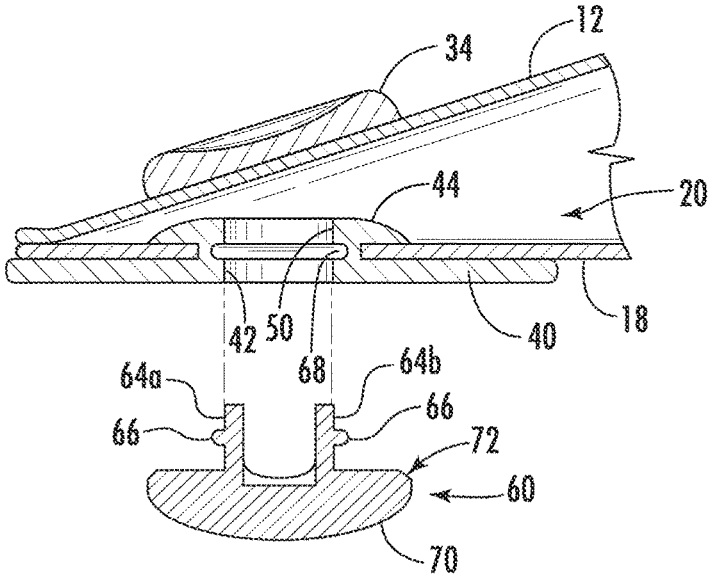
FIG. 13 is an enlarged side sectional view of the dispensing end of the combination patching compound dispenser and applicator of FIG. 12 shown with a cap for insertion into the applicator opening.

Reference now being made to FIGS. 12 and 13, in some embodiments of the subject invention, fastener 44 is adapted to removably receive a variety of peripheral articles (accessories) such as a removable mesh applicator disc assembly 58 (FIG. 12) and a closure cap 60 (FIG. 13). Other inserts not shown, but easily understood by those skilled in the art, include applicator discs of various sizes and inserts used to reduce the size of applicator disc opening 42. With continued reference to FIG. 12, an embodiment of a removable mesh applicator disc assembly 58 of the subject invention is comprised of a disc-shaped mounting plate 62 having a top surface 62*a* and bottom surface 62*b*, a mesh applicator disc 54 mounted to bottom surface 62*b* of mounting plate 62, and a pair of flexible stanchions 64*a,b* extending perpendicularly from top surface 62*a* of mounting plate 62. Mounting plate 62 and mesh applicator disc 54 are substantially diametrically equal and each include centrally located holes 62*h* and 56, respectively, which are concentrically aligned with one another. Stanchions 64*a,b* are positioned on opposite sides of hole 62*h* of mounting plate 62 and are spaced for slidable engagement with the surface of bore 50. Each stanchion 64*a,b* includes a semispherical protuberance 66 projecting outwardly along a radius of mounting plate 62 in opposite directions from one another. Each protuberance 66 is sized for mating engagement with annular groove 68 disposed in the surface of bore 50. As may be appreciated, the flexible nature of stanchions 64*a,b* facilitates disengagement of protuberances 66 from annular groove 68 when mesh applicator disc assembly 54 is pulled from fastener 44. Referring to FIG. 13, cap 60 includes the same stanchion and protuberance components as mesh applicator disc assembly 54 for removably mounting cap 60 in bore 50. In one embodiment, cap 60 includes a dome-shaped head 70 having a beveled edge 72 about its circumference to facilitate removal of cap 60 by inserting a fingernail or the like under cap head 70 to pinch cap 60 free from bore 50.

Figure 14:
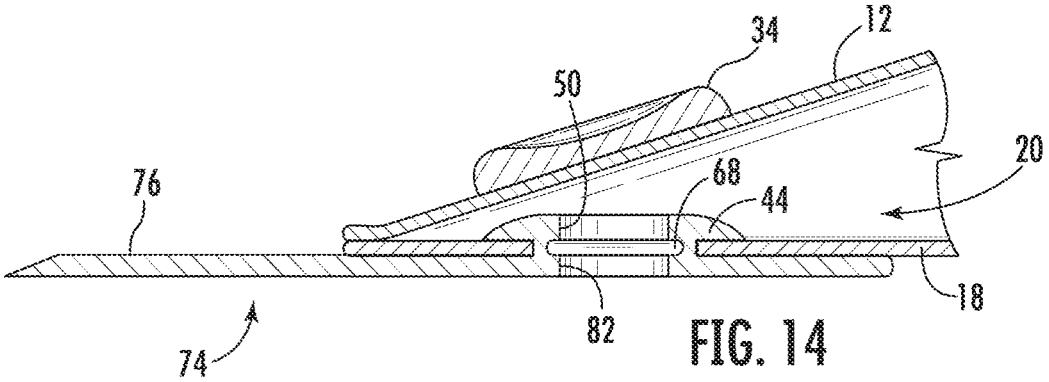
FIG. 14 is an enlarged side sectional view of the dispensing end of another embodiment of a combination patching compound dispenser and applicator of the subject invention wherein the applicator is in the form of a spatula.
Figure 15:
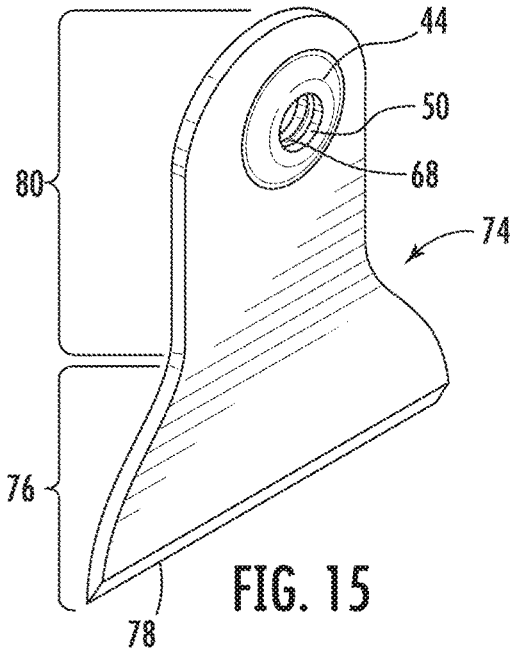
FIG. 15 is a perspective view of the spatula component of FIG. 14.
Figure 16:
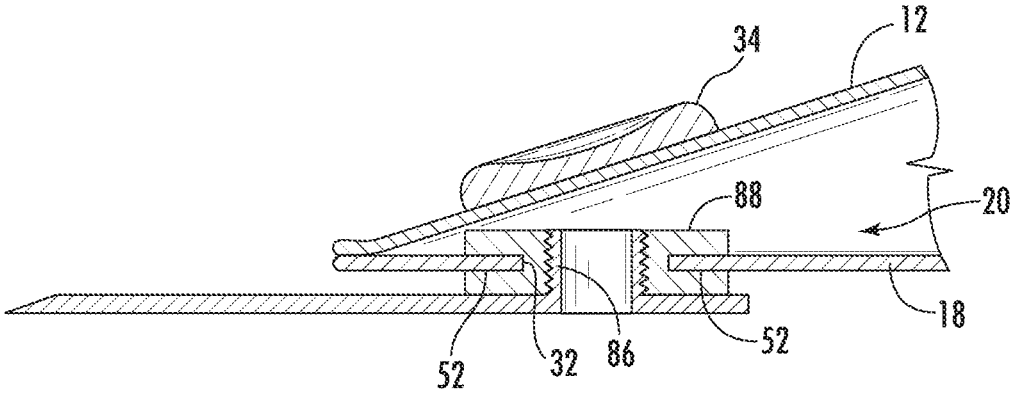
FIG. 16 is an enlarged side sectional view of the dispensing end of another embodiment of a combination patching compound dispenser and applicator of the subject invention showing a removable spatula.
Figure 17:
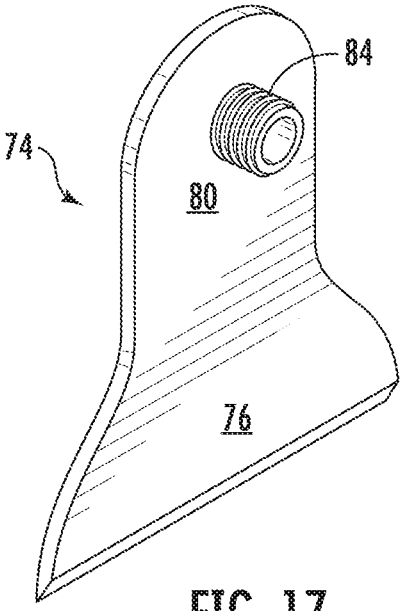
FIG. 17 is a perspective view of the threaded spatula of FIG. 16.

Reference now being made to FIGS. 14 and 15, an embodiment of the subject dispenser/applicator 10 is illustrated wherein the applicator disc 40 has been substituted with a spatula 74. Spatula 74 includes a blade portion 76 terminating in a straight beveled edge 78, and a flat handle portion 80 having a centrally disposed orifice 82 in communication with bore 50 of fastener 44 and dispensing aperture 32 of bag 12. Spatula handle portion 80 may be integrally formed with fastener 44 (as shown) or the two may be separate components mated together. Like applicator disc 40 shown in FIG. 6, spatula 74 can be fixed to side-wall 18 directly using an adhesive, in addition or as an alternative to, mounting with fastener 44. As illustrated in FIGS. 16 and 17, spatula 74 may be modified with a threaded spigot 84 for removable mounting within reciprocally threaded socket 86 which is centrally disposed within receiver 88 which in turn is fixedly mounted about the circumferential edge 52 of dispensing aperture 32.

Although the present invention has been described with reference to the particular embodiments herein set forth, it is understood that the present disclosure has been made only by way of example and that numerous changes in details of construction may be resorted to without departing from the spirit and scope of the invention. Thus, the scope of the invention should not be limited by the foregoing specifications, but rather only by the scope of the claims appended hereto.

What is claimed as being new, useful and desired to be protected by Letters Patent of the United States is as follows:

1. A patching compound dispenser, comprising:

a. a generally cone-shaped non-rigid container comprised of a side-wall having a normally open proximal end through which patching compound may be introduced into said container, and a distal end terminating in a closed tip;

b. a dispensing aperture disposed through said side-wall proximate said tip; and c. an elevated fingertip rest on said side-wall opposite said dispensing aperture, said elevated fingertip rest having a concave depression for receiving a user's fingertip;

whereby patching compound may be dispensed through said dispensing aperture by applying finger pressure to said fingertip rest, thusly deforming said side-wall locally thereby forcing the patching compound through said dispensing aperture.

2. The patching compound dispenser of claim 1, further including an applicator disc attached to said side-wall and having a centered opening in communication with said dispensing aperture.

3. The patching compound dispenser of claim 2, wherein said applicator disc has a top side-wall facing surface and a bottom surface, said bottom surface having a mesh applicator disc attached thereto.

4. The patching compound dispenser of claim 3, wherein said mesh applicator disc has a hole disposed therethrough and in communication with said opening of said applicator disc; said opening having a diameter; said hole having a diameter equal to said diameter of said opening.

5. The patching compound dispenser of claim 2, wherein said applicator disc has an outer diameter and an inner diameter; said outer diameter being at least twice the size of said inner diameter.

6. The patching compound dispenser of claim 5, wherein said applicator disc has a top side-wall facing surface and a bottom surface, said bottom surface having a mesh applicator disc attached thereto.

7. The patching compound dispenser of claim 6, wherein said mesh applicator disc has a hole disposed therethrough and in communication with said opening of said applicator disc; said opening having a diameter; said hole having a diameter equal to said diameter of said opening.

8. The patching compound dispenser of claim 5, wherein said outer diameter is between 10 mm and 100 mm.

9. The patching compound dispenser of claim 8, wherein said applicator disc has a top side-wall facing surface and a bottom surface, said bottom surface having a mesh applicator disc attached thereto.

10. The patching compound dispenser of claim 9, wherein said mesh applicator disc has a hole disposed therethrough and in communication with said opening of said applicator disc; said opening having a diameter; said hole having a diameter equal to said diameter of said opening.

11. A patching compound dispenser, comprising:

a. a generally cone-shaped non-rigid container comprised of a side-wall having a normally open proximal end through which patching compound may be introduced into said container, and a distal end terminating in a closed tip;

b. a dispensing aperture disposed through said side-wall proximate said tip;

c. an elevated fingertip rest on said side-wall opposite said dispensing aperture, said elevated fingertip rest having a concave depression for receiving a user's fingertip; and d. a fastener circumscribing said dispensing aperture and having a central bore in communication with said chamber;

whereby patching compound may be dispensed through said bore of said fastener by applying finger pressure to said fingertip rest, thusly deforming said side-wall locally thereby forcing the patching compound through said bore.

12. The patching compound dispenser of claim 11, further including an applicator disc removably attached to said fastener and having a centered opening in communication with said bore of said fastener.

13. The patching compound dispenser of claim 12, wherein said applicator disc has a top side-wall facing surface and a bottom surface, said bottom surface having a mesh applicator disc attached thereto.

14. The patching compound dispenser of claim 13, wherein said mesh applicator disc has a hole disposed therethrough and in communication with said opening of said applicator disc; said opening having a diameter; said hole having a diameter equal to said diameter of said opening.

15. The patching compound dispenser of claim 12, wherein said applicator disc has an outer diameter and an inner diameter; said outer diameter being at least twice the size of said inner diameter.

16. The patching compound dispenser of claim 15, wherein said applicator disc has a top side-wall facing surface and a bottom surface, said bottom surface having a mesh applicator disc attached thereto.

17. The patching compound dispenser of claim 16, wherein said mesh applicator disc has a hole disposed therethrough and in communication with said opening of said applicator disc; said opening having a diameter; said hole having a diameter equal to said diameter of said opening.

18. The patching compound dispenser of claim 15, wherein said outer diameter is between 10 mm and 100 mm.

19. The patching compound dispenser of claim 18, wherein said applicator disc has a top side-wall facing surface and a bottom surface, said bottom surface having a mesh applicator disc attached thereto.

20. The patching compound dispenser of claim 11, wherein said fastener is adapted to removably receive a peripheral device selected from the group consisting of a cap for closing said bore, an applicator disc having a centered opening in communication with said bore, a mesh applicator disc assembly, and a spatula.

* * * * *